US005295338A

United States Patent [19]

Guffey et al.

[11] Patent Number: 5,295,338

[45] Date of Patent: Mar. 22, 1994

[54] BUILDING PANEL ASSEMBLY

[75] Inventors: Kenneth J. Guffey, Manheim; Meredith W. Croucher, Jr., Landisville; Michael A. Huizinga, Columbia; Russell H. Henk, Millersville, all of Pa.

[73] Assignee: Alcan Aluminum Corporation, Cleveland, Ohio

[21] Appl. No.: 817,787

[22] Filed: Jan. 8, 1992

[51] Int. Cl.[5] ..... E06B 3/54

[52] U.S. Cl. ..... 52/478; 52/521

[58] Field of Search ..... 52/478, 519, 520, 521, 52/531, 536, 537, 57

[56] References Cited

U.S. PATENT DOCUMENTS

| | | | |
|---|---|---|---|
| 540,913 | 6/1895 | Hille . | |
| 567,700 | 8/1896 | Vogan . | |
| 1,150,425 | 8/1915 | Gore . | |
| 1,221,370 | 4/1917 | Overbury et al. . | |
| 1,452,362 | 4/1923 | Clifton et al. . | |
| 1,634,126 | 6/1927 | Tyra . | |
| 1,638,755 | 8/1927 | Tyra . | |
| 1,648,081 | 11/1927 | Tyra . | |
| 1,653,847 | 12/1927 | Greenstreet . | |
| 1,829,123 | 10/1931 | Warren . | |
| 1,963,583 | 6/1934 | Jenkins . | |
| 1,975,842 | 10/1934 | Gillett et al. . | |
| 2,124,830 | 7/1938 | Roth | 52/521 |
| 2,160,642 | 5/1939 | Bumpas et al. . | |
| 2,210,599 | 8/1940 | Percy, Jr. . | |
| 2,438,099 | 3/1948 | Whitehouse . | |
| 2,626,577 | 1/1953 | Roush et al. . | |
| 2,832,300 | 4/1958 | Jacobson . | |
| 3,059,733 | 10/1962 | Hermann . | |
| 3,114,218 | 12/1963 | Macquere . | |
| 3,157,965 | 11/1964 | Watson . | |
| 3,486,277 | 12/1969 | Bauer . | |
| 3,593,479 | 7/1971 | Hinds et al. . | |
| 3,875,715 | 4/1975 | Martin et al. . | |
| 3,886,705 | 6/1975 | Cornland . | |
| 3,899,855 | 8/1975 | Gadsby . | |
| 4,109,438 | 8/1978 | De la Concha . | |
| 4,130,974 | 12/1978 | Chalmers et al. . | |
| 4,189,889 | 2/1980 | Yanoh . | |
| 4,301,628 | 11/1981 | Lowe . | |
| 4,411,120 | 10/1983 | Ellis et al. . | |
| 4,499,700 | 2/1985 | Gustafsson . | |
| 4,700,522 | 10/1987 | Simpson . | |
| 4,759,165 | 7/1988 | Getoor et al. . | |
| 4,878,331 | 11/1989 | Taylor . | |
| 4,926,611 | 5/1990 | Funaki . | |
| 4,934,120 | 6/1990 | Boyd | 52/521 X |
| 5,012,623 | 5/1991 | Taylor . | |

FOREIGN PATENT DOCUMENTS

| | | |
|---|---|---|
| 1147824 | 4/1956 | France . |
| 2309692 | 3/1976 | France . |
| 336998 | 2/1936 | Italy . |
| 506222 | 6/1939 | United Kingdom . |

*Primary Examiner*—Carl D. Friedman
*Assistant Examiner*—Creighton Smith
*Attorney, Agent, or Firm*—Cooper & Dunham

[57] ABSTRACT

This invention provides a panel assembly for buildings and the like comprising, in combination with structure supporting the assembly, an array of overlapping elongated metal panels, each panel including a lower edge, an upper flange, and a web including at least one outwardly protruding longitudinally extending stiffening rib. The stiffening rib adjacent the upper flange has an elongated longitudinally extending groove and an extended bearing portion for contacting the structure when the panel is fastened thereto. These ribs provide structural support without purlins, sheathing, or the like. A plurality of fasteners for attaching the panel assembly to the structure pierce the extended bearing portion hold the bearing portion in contact with the structure so that when panels are affixed to the structure with the lower edge of one panel overlapping the upper flange of another panel, the groove forms a space between overlapping panels to prevent water from flowing around the stiffening rib adjacent the upper flange.

5 Claims, 5 Drawing Sheets

BUILDING PANEL ASSEMBLY

BACKGROUND OF THE INVENTION

This invention relates to assemblies of metal panels for buildings, shelters and the like, such as are used principally for roofs or sidewalls, and to methods for assembling such panels. More particularly, the invention is directed to metal roof Panel assemblies which provide a secure, structurally sound, weathertight roof without use of roof decking or purlins.

In the building arts, building panel assemblies, typically made of a sheet metal such as aluminum or steel, have been used as roofing or siding materials. Where the panel assembly is a roof, a plurality of rafters or roof trusses joined together form the underlying structural support for the roof. Sheathing or longitudinally extending purlins overlie the rafters or roof trusses to brace and interlock the supports. Such sheathing or purlins with metal roofing running perpendicular to the purlins brace the top chords of the trusses and may transfer horizontal loads such as wind and the like to the endwalls and sidewalls of the building by diaphragm action. An example of a seamed rib metal panel assembly is disclosed in U.S. Pat. No. 4,099,356 (Graham). The panels have projecting side flanges interlocked to constitute a seamed rib, and use anchor clips mounted on the supporting structure, such as sheathing or purlins, and held in the seamed rib between interlocked flanges for securing the panels to the structure.

More recently, attempts have been made to provide weathertight roof panels which affix directly to the rafters or roof trusses without first covering the rafters or other frame members with sheathing or purlins before applying the external roofing. U.S. Pat. No. 4,499,700 (Gustafsson) discusses one attempted effort to provide such a system.

SUMMARY OF THE INVENTION

The invention provides a panel assembly for buildings and the like comprising in combination with structure supporting the assembly and an array of overlapping elongated metal panels. Each panel includes a lower edge, an upper flange, and a web including (1) at least one outwardly protruding longitudinally extending stiffening rib, the stiffening rib adjacent the upper flange having an elongated longitudinally extending groove; and (2) an extended bearing portion for contacting the structure when the panel is fastened thereto, and a plurality of fasteners for attaching the panel assembly to the structure which pierce the extended bearing portion and hold the bearing portion in contact with the structure so that when panels are affixed to the structure with the lower edge of one panel overlapping the upper flange of another panel, the groove forms a space between overlapping panels to prevent water from flowing around the stiffening rib adjacent the upper flange.

This invention also provides a panel assembly for buildings and the like comprising, in combination with structure supporting the assembly, an array of overlapping elongated metal panels, each panel including a lower edge, an upper flange, and a web including at least one outwardly protruding longitudinally extending stiffening rib. The stiffening rib adjacent the upper flange has an elongated longitudinally extending groove and an extended bearing portion for contacting the structure when the panel is fastened thereto. These ribs provide structural support without purlins, sheathing, or the like. A plurality of fasteners for attaching the panel assembly to the structure which pierce the extended bearing portion hold the bearing portion in contact with the structure so that when panels are affixed to the structure with the lower edge of one panel overlapping the upper flange of another panel, the groove forms a space between overlapping panels to prevent water from flowing around the stiffening rib adjacent the upper flange.

The invention further provides a roof panel assembly for buildings, shelters and the like, comprising in combination a plurality of spaced, substantially parallel angled rafters for supporting a roof panel assembly. The rafters form a pitched roof frame having an apex and two base ends engaging a support member of the building, or are arrayed to form what is known in the art as a monoslope roofline. Optional flashings cover each eave defined by the base ends on a respective side of the building. Each flashing has a bend to conform the flashing to the eave and may include an outwardly extending recurved lip at an edge thereof. The assembly further includes an array of overlapping elongated metal panels, each having a lower edge preferably including a recurved lip, an upper flange, and a web disposed therebetween. The web includes a plurality of spaced, outwardly protruding longitudinally extending stiffening ribs. The stiffening rib adjacent the upper flange has an elongated, longitudinally extending groove and an extended bearing portion for contacting the structure when the panel is fastened thereto. When the panels are affixed to the trusses using fasteners which pierce the extended bearing portion to hold the bearing portion in contact with the structure with the lower edge of one panel overlapping the stiffening rib adjacent the upper flange of another panel, the groove forms a space between overlapping panels to prevent water from flowing by capillary action around the stiffening rib adjacent the upper flange. The lower edge of one panel overlaps the upper flange of an adjacent panel and the two panels are fastened to an underlying support member by a single sealing fastener penetrating through overlapping portions of the upper and lower flanges. The invention thus provides a combination of roof panels, rafter or truss top chord bracing, and diaphragm panel that eliminates the need for sheathing or purlins.

The panel assembly additionally may include a ridge flashing member for use in building structures having trusses or rafters forming an apex. The ridge flashing member has first and second legs forming an angle therebetween conforming to the pitch defined by the plurality of roof rafters or trusses, with the outer edge of the first and second legs preferably having a recurved lip. As with adjacent panels, the ridge flashing is fastened on each side by a fastener penetrating through the overlapping portion of a respective leg and the upper flange of the roof panel adjacent the apex.

Further features and advantages of the invention will be apparent from the detailed description of the preferred embodiments set forth below, taken in conjunction with the accompanying drawings.

DETAILED DESCRIPTION OF THE PREFERRED EMBODIMENTS

Figure 1:
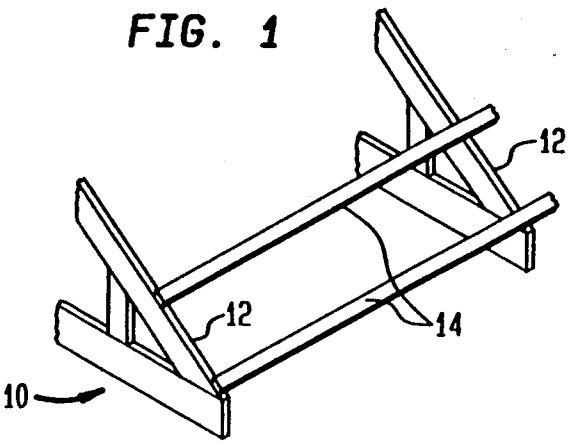
FIG. 1 is a fragmentary perspective view illustrating the underlying roof structure of a building or shelter including support members and purling.

Referring to the drawings, FIG. 1 illustrates a portion of a typical wooden support structure for a building, shelter or the like. The support structure 10 typically includes a plurality of spaced wooden rafters 12 which are braced by purlins 14, usually two-by-fours lying flat (illustrated) or upright (not shown). Alternatively or additionally, plywood or other sheathing (not shown) may be used to brace and interlock the rafters 12 or roof trusses. The cost for labor and materials involved in installing purlins may be significant or undesirable for some structures or shelters such as agricultural, commercial, residential and light industrial applications, where building cost must be kept as low as possible, without significantly compromising strength and weathertightness.

Figure 2:
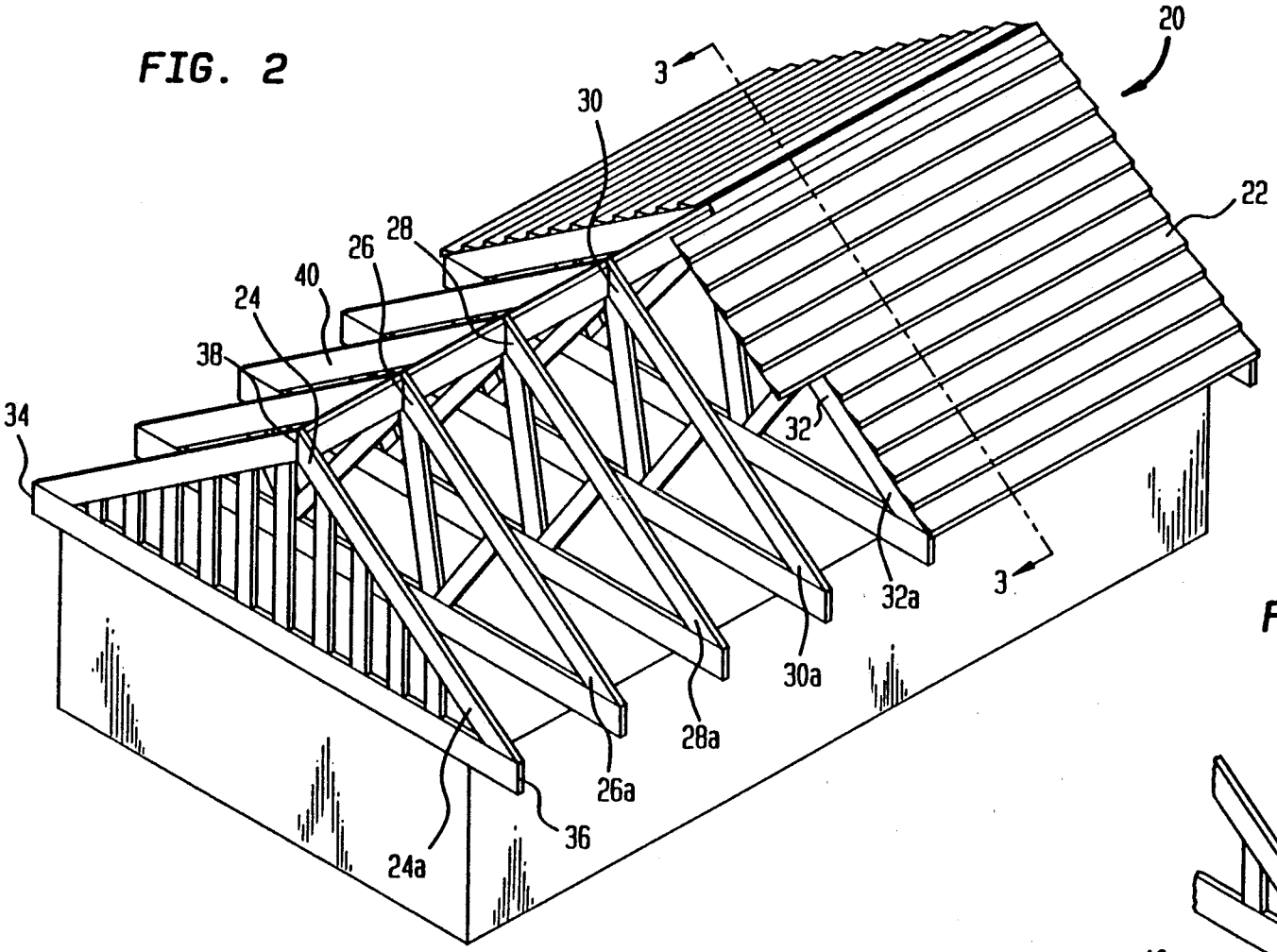
FIG. 2 is a perspective view, partially broken away, of a building panel assembly of the present invention installed on a support structure without purlins or sheathing.

FIG. 2 shows the roof panel assembly 20 of the present invention, which enables construction of strong weathertight roofs without use of purlins or sheathing. In this embodiment, the roof panel assembly 20 of the present invention is shown installed in an angled, as opposed to monoslope, roof support, it being understood by those skilled in the art that the present invention can also be used with monoslope or other types of roof structures, or as a wall panel for such buildings. The assembly 20 includes elongated roof panels 22 mounted on supporting wooden substructure such as opposed, angled wooden roof rafters 24, 26, 28, 30, 32. In the present exemplary embodiment, prefabricated cross-braced roof trusses 24a, 26a, 28a, 28b, 30a, 32a are used as support members on which the roof panel assembly 20 can be affixed. Each roof truss includes a base having a pair of ends 34, 36 and an apex 38. The roof trusses 24a–32a are placed in spaced relationship on longitudinally extending support members or vertical support members of the building structure (not shown). Optionally, the array of roof trusses 24a–32a are interlocked using braces 40 between adjacent roof trusses.

Figure 6A:
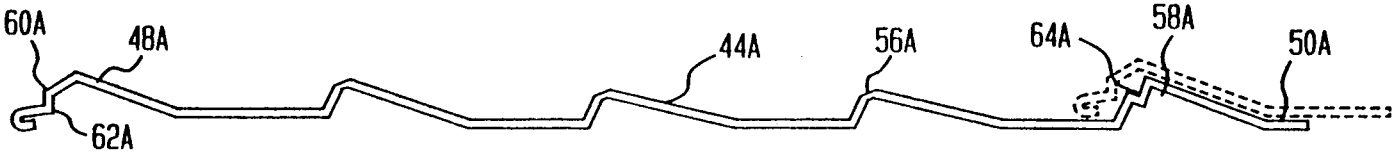
FIGS. 6a–6c are side sectional views of a second preferred embodiment of a panel for use in the building assembly shown in FIG. 2.
Figure 6C:
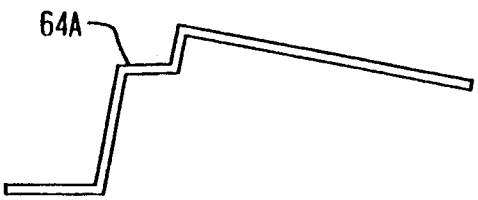
Figure 6B:
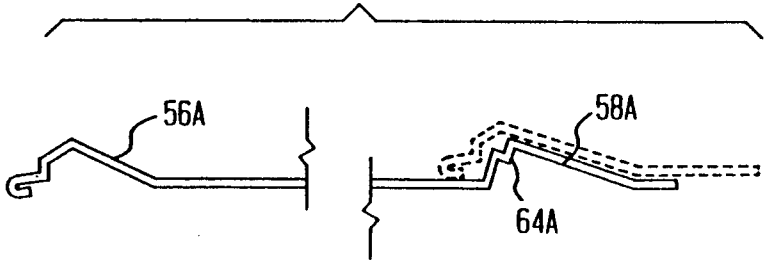
Figure 7A:
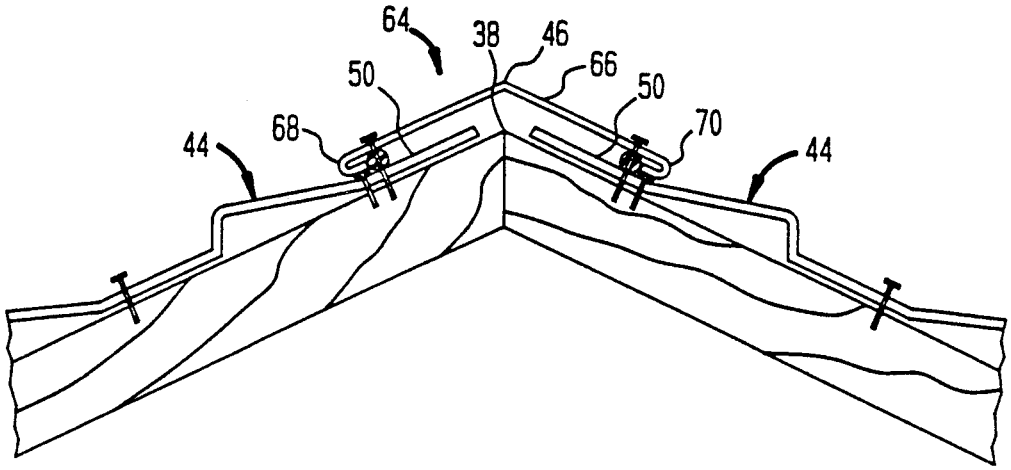
FIGS. 7a–7b are side sectional views of a preferred embodiment of a ridge flashing for use in the building panel assembly shown in FIG. 2.
Figure 7B:
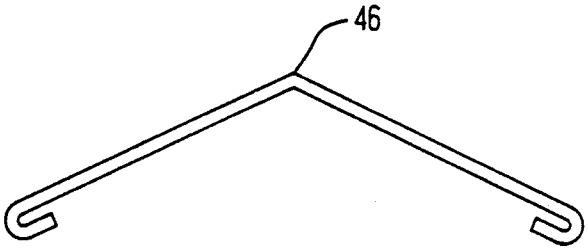

The roof panel assembly 20 of the present invention comprises three principal parts: the optional eave flashing 42 (shown in FIGS. 3 and 4); the roof panel 44 (shown in FIGS. 3, 5a–5c and 6a–6c); and a ridge flashing 46 (shown in FIG. 7). Each of the metal panels 44 is fabricated of galvanized steel (preferably grade E having a thickness of about 0.0165 inches to about 0.0276 inches) or roll-formed sheet aluminum strip (preferably alloy no. 3004-H16, having a thickness of 0.0295 inches to 0.040 inches). The panels may be embossed and painted, or left unpainted. Preferably, the panel is formed from a roll 46 to 46-3/16 inches wide,, depending on the particular final size and shape desired. By way of example, after forming, the panel 44 may have a width of about 42¼ to about 42½ inches and roofing coverage of about 36 inches. Length may vary according to building size.

Figure 3:
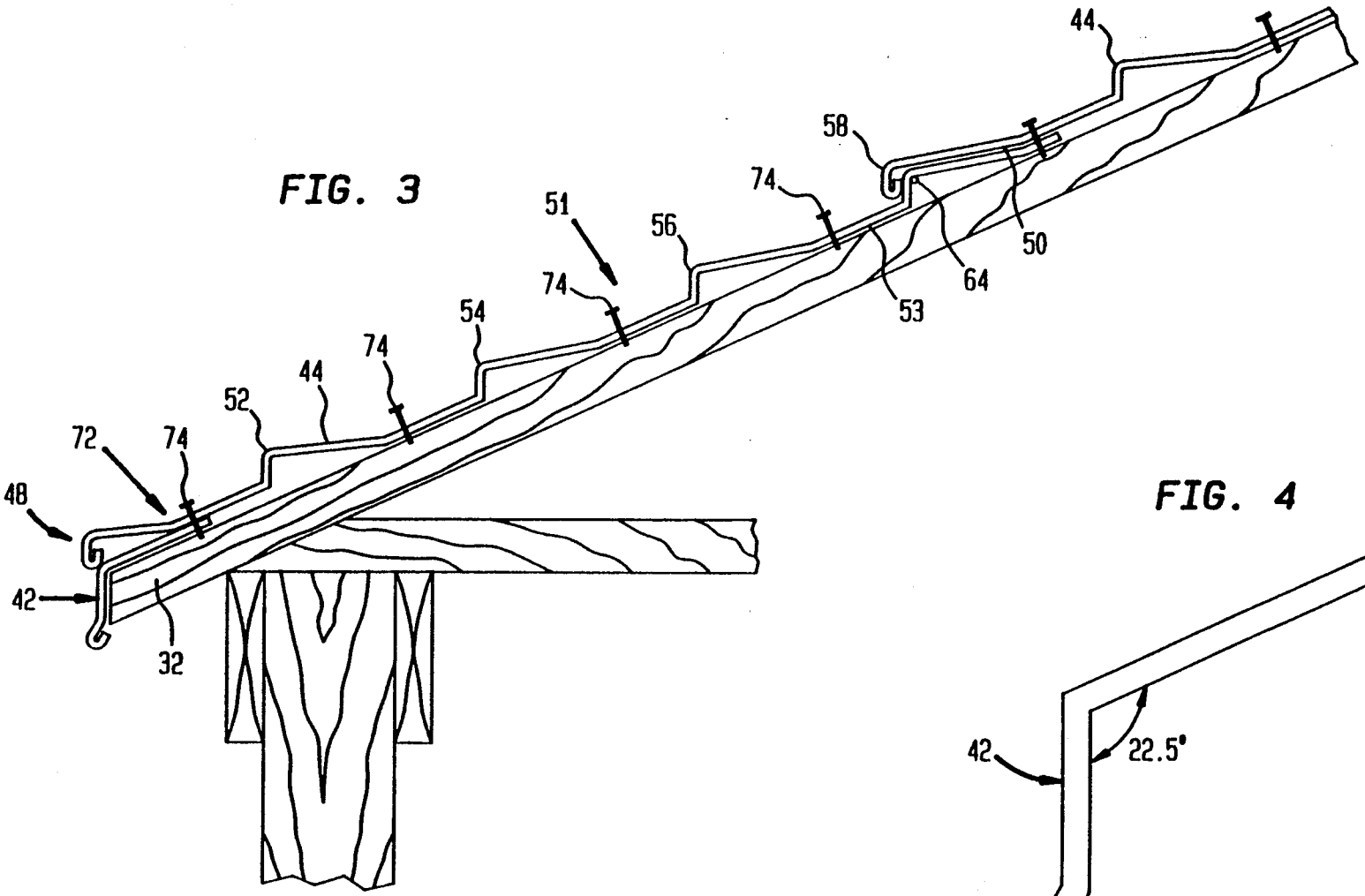
FIG. 3 is a sectional view partially broken away taken along line 3—3 of FIG. 2.
Figure 4:
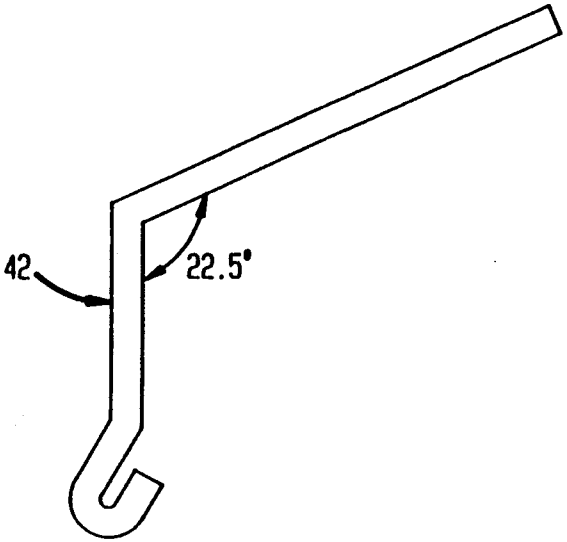
FIG. 4 is a side sectional view of an optional flashing member for use in the building panel assembly of the present invention.
Figure 5A:
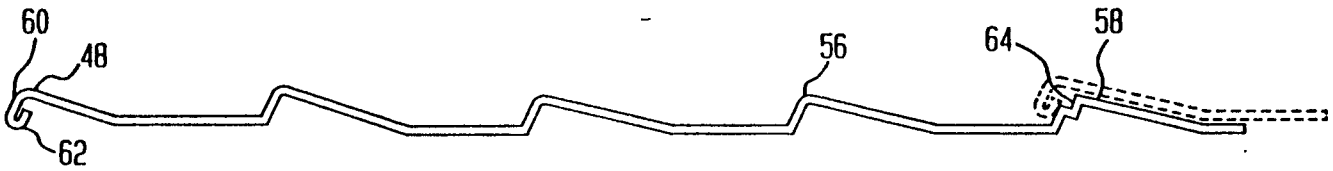
FIGURES 5a–5c are side sectional views of a first preferred embodiment of a panel for use in the building panel assembly shown in FIG. 2.
Figure 5C:
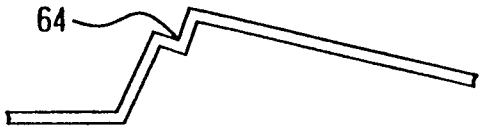
Figure 5B:
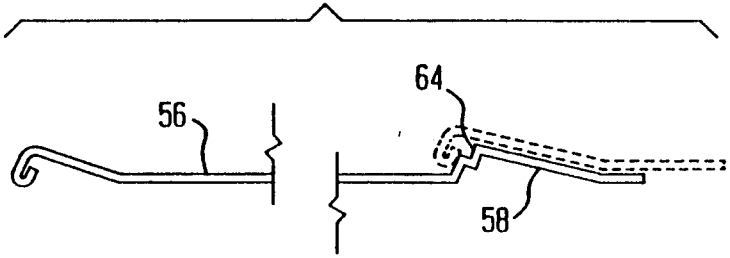

The shape of a particular panel 44 is best understood with reference to FIGS. 2, 3, 5a–c, and 6a–c. FIGS. 5a–5c and 6a–6c show two different embodiments of the panel for use in the present invention. Generally, each panel 44 includes a lower edge 48 and an upper flange 50 as shown in FIGS. 3, 5a, and 6a. Each metal panel 44 further includes a web 51 including at least one, but preferably a plurality or array of spaced apart, outwardly protruding longitudinally extending ribs 52, 54, 56, 58 to stiffen and strengthen the panel 44. The rib 58 adjacent or closest to the upper flange 50 includes an elongated longitudinally extending groove 64 to help prevent water from being carried around the longitudinal rib 58 where it can seep into the interior of the building (not shown). The web 51 further includes an extended bearing portion 53 for contacting the structure (e.g., the rafters 24–32 or the roof trusses 24a–32a) when the panel 44 is fastened thereto.

As mentioned above, the panel 44 may be constructed in accordance with one of two presently preferred embodiments, the one illustrated in FIGS. 6a–6c or the one illustrated in FIGS. 5a–6c. The two embodiments differ mostly in the construction and geometry of their lower edge 48. In the first embodiment shown in FIGS. 5a and 5b, the lower edge 48 of the first embodiment has a shape designed to conform to and cover the uppermost rib 58 (FIGS. 3 and 5a) and overlap the upper flange 50 and the groove 64 formed in the upper flange 50 (as best shown in FIG. 5a) The lower edge 48 has a downward leading edge 60 and a recurved lip 62.

By comparison, the embodiment of the metal panel 44 as shown in FIG. 6a, has a slightly different geometry and shape to its lower edge 48a. Instead of angling downward as in the lower edge 48 in FIG. 5a, the panel 44a of the second embodiment shown in FIG. 6a, includes an extending leading edge 60a including a recurved lip 62a. The additional outwardly extending leading edge 60a, may advantageously be used in certain applications where the extension may provide added strength, support and weathertightness.

Another important feature of the invention resides in the construction of the channel or groove 64 located in the rib 58 adjacent the upper flange 50. Comparing two adjacent ribs 56, 58 in FIG. 5a for example, the exposed rib 56 appears wedge shaped, whereas the groove 64 in the rib 58 adjacent the upper flange 50 has a distinct notched appearance in the side sectional view of FIG. 5a. Preferably, it is formed to be a slightly obtuse angle of about 105°. The groove 64 or channel, when overlapped by the lower edge 48 of another panel 44 forms an air space dimensioned to disrupt or interrupt the capillary action of water around the stiffening rib 58 adjacent the upper flange 50 to help prevent water, rain and other forms of condensation from seeping inside the building.

The ridge flashing 46, as illustrated in FIG. 7, includes first and second legs 64, 66 angled to conform to the apex 38 formed by the rafters 24–32 or roof trusses 24a–32a, as shown in FIG. 2. Each leg 64, 66 of the ridge flashing 46 includes an optional recurved lip 68, 70 to provide added strength and avoid unnecessary sharp edges. The ridge flashing 46 covers the upper flange 50 on the roof panel 44 on each side of the apex 38 or ridge.

Referring to FIG. 3, in installation of the assembly 20, optional eave flashings 42 are first positioned along the base ends of the rafters 24–32 or roof trusses **24*a*–32*a*. The first panel 44 is overlaid so that the lower edge 48 overlaps the angle of the bend of the eave flashing 42. A bead of a watertight sealant 72, such as butyl sealant tape or other sealant suitable for roofing, is placed on the eave flashing 42 near where the first rib 48 ends to provide a water tight joint between the panel 44 and the eave flashing 42. A single, preferably washered, screw 74 or other watertight fastener is driven through both the panel 44 and the eave flashing 42 in the area where the two members overlap and the sealant bead 72 is located. The screw 74 or other fastener pierces the extended bearing portion 53 and the rafters 24–32 or roof trusses 24*a*–32*a*. When sufficiently tightened, the panel 44 is affixed to the structure, which provides structural support to the panel 44. Additional screws 74 are placed between adjacent ribs 52, 54 to attach the panel 44 to the underlying roof rafters 24–32 or roof trusses 24*a*–32*a***.

Before the upper flange 50 is screwed in place, the next panel 44 is overlapped so that the lower edge 48 of that panel overlaps the channel 64 and uppermost rib 58 of the panel 44 already in place. As shown in FIG. 3, the overlap near the channel 64 or groove creates an air space which interrupts capillary flow of water around and over the rib 58 closest to the upper flange 50. An optional bead of a suitable roofing sealant (not shown) may be placed on the upper flange 50 and a single screw 74 or other watertight fastener fastens both the upper flange 50 and the overlapping panel 44 to the underlying roof rafter. The attachment of panels 44 continues until the panels 44 cover the side of the roof up to the apex 38 formed by the roof rafters 24–32 or the roof trusses **24*a*–32*a*. A ridge flashing 46 may be installed as shown in FIG. 7. A bead of sealant 72 is placed in the upper flange 50 of the upper most panel 44. A single screw fastens the legs 64, 66 of the ridge flashing 46 and the upper flange 50 of the panels 44 adjacent the apex 38 of the roof. The recurved lip 68, 70 contacts and overlaps the upper flanges So of the uppermost panels 44 creating a weathertight seal at the apex 38** of the roof.

It should be understood that the invention is not limited to the features and embodiments hereinabove specifically set forth, but may be carried out in other ways without departure from its spirit.

We claim:

1. A panel assembly for buildings and the like comprising in combination with structure supporting the assembly, an array of elongated metal panels affixed directly to rafters in the support structure, each panel including a lower edge, an upper flange, and a web including (1) at least one outwardly protruding longitudinally extending stiffening rib, the stiffening rib adjacent the upper flange having an elongated longitudinally extending groove; and (2) an extended bearing portion for contacting the structure when the panel is fastened thereto, a plurality of fasteners for attaching the panel assembly to the structure which pierce the extended bearing portion and hold the bearing portion in contact with the structure so that when panels are affixed to the structure with the lower edge of one panel overlapping the upper flange of another panel, the groove forms a space between overlapping panels to prevent water from flowing around the stiffening rib adjacent the upper flange, and first and second flashings covering an eave defined by downward ends of a plurality of rafters included in the structure supporting the assembly, each flashing having a bend conforming the flashing to the eave, and an outwardly extending recurved lip at an edge of the first and second flashings, wherein the array of elongated metal panels are affixed directly to rafters in the support structure, without the need for sheathing or longitudinally extending purlins, and that braces the rafters or truss top chords and transfers horizontal loads such as wind and the like to the endwalls and sidewalls of the building by diaphragm action.

2. A panel assembly as defined in claim 1, additionally including a ridge flashing having first and second legs forming an angle therebetween which conforms to an apex defined by a plurality of opposed roof rafters.

3. A roof panel assembly for buildings and the like, comprising in combination:

a plurality of spaced, substantially parallel opposed and angled rafters, the opposed and angled rafters defining an apex and a pair of eaves on respective sides of a building;

an array of overlapping elongated metal panels, each panel including a lower edge, an upper flange, and a web including (1) at least one outwardly protruding longitudinally extending stiffening rib, the stiffening rib adjacent the upper flange having an elongated longitudinally extending groove; and (2) an extended bearing portion for contacting the structure when the panel is fastened thereto;

a plurality of fasteners for attaching the panel assembly to the structure which pierce the extended bearing portion and hold the bearing portion in contact with the structure so that when panels are affixed to the structure with the lower edge of one panel overlapping the upper flange of another panel, the groove forms a space between overlapping panels to prevent water from flowing around the stiffening rib adjacent the upper flange; and first and second flashings for covering one of the pair of eaves, each flashing fastened to base ends of the rafters adjacent the eave and having a bend to conform to the eave.

4. A panel assembly as defined in claim 3, additionally including a ridge flashing member having first and second legs forming an angle therebetween conforming to apex defined by the plurality of roof rafters, an outer edge of the first and second legs having a recurved lip.

5. A roof assembly as defined in claim 4, wherein the ridge flashing is fastened on each side by a fastener penetrating through overlapping portions of the first and second legs and opposed upper flanges of roof panels adjacent said apex.

* * * * *